US009928791B2

(12) United States Patent
Ahn et al.

(10) Patent No.: US 9,928,791 B2
(45) Date of Patent: Mar. 27, 2018

(54) DISPLAY APPARATUS AND METHOD OF DRIVING WITH PIXELS ALTERNATIVELY CONNECTED TO ADJACENT GATE LINES

(71) Applicant: Samsung Display Co., Ltd., Yongin, Gyeonggi-Do (KR)

(72) Inventors: Kuk-Hwan Ahn, Hwaseong-si (KR); Seokyun Son, Yongin-si (KR); Jai-Hyun Koh, Hwaseong-si (KR); Geunjeong Park, Daegu (KR); Dong-Won Park, Hwaseong-si (KR); Donghwa Shin, Yongin-si (KR); Won Sik Oh, Seoul (KR); Ik Soo Lee, Seoul (KR); Sang-Uk Lim, Yongin-si (KR); Seokha Hong, Yongin-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 35 days.

(21) Appl. No.: 14/688,702

(22) Filed: Apr. 16, 2015

(65) Prior Publication Data

US 2016/0071473 A1 Mar. 10, 2016

(51) Int. Cl.
*G09G 3/36* (2006.01)

(52) U.S. Cl.
CPC ..... *G09G 3/3655* (2013.01); *G09G 3/3607* (2013.01); *G09G 3/3614* (2013.01);
(Continued)

(58) Field of Classification Search
CPC .. G09G 3/3655; G09G 3/3607; G09G 3/3614; G09G 3/3648; G09G 2310/0218;
(Continued)

(56) References Cited

U.S. PATENT DOCUMENTS 8,587,504 B2 11/2013 Joo
2008/0150862 A1* 6/2008 Tseng ..... G09G 3/3648 345/88

(Continued)

FOREIGN PATENT DOCUMENTS

EP 2953127 A2 12/2015
KR 1020110077899 A 7/2011

(Continued)

OTHER PUBLICATIONS

Carsten Dolar et al. : "A multiprimary display model combined with a spatio-temporal behavioral display model for display characterization by simulation" SPIE-IS&T vol. 7241, 724108-1, 10 pages, 2009.

*Primary Examiner* — Liliana Cerullo
(74) *Attorney, Agent, or Firm* — Innovation Counsel LLP

(57) ABSTRACT

According to an embodiment, a display apparatus includes gate lines extending in a first direction, data lines extending in a second direction crossing the first direction, and pixels connected to the gate lines and the data lines. The pixels include pixels arranged in a k-th row and pixels arranged in a (k+1)th row disposed adjacent to the pixels arranged in the k-th row in the second direction. An (i+1)th gate line is disposed between the pixels in the k-th row and the pixels in the (k+1)th row. A first pixel arranged in a g-th column among the pixels arranged in the k-th row and a second pixel arranged in the g-th column among the pixels arranged in the (k+1)th row are connected to a j-th data line. The pixels arranged in the k-th row are alternately connected to an i-th gate line and the (i+1)th gate line.

30 Claims, 12 Drawing Sheets

(52) U.S. Cl.
CPC ... *G09G 3/3648* (2013.01); *G09G 2300/0426* (2013.01); *G09G 2300/0452* (2013.01); *G09G 2300/0842* (2013.01); *G09G 2310/0218* (2013.01); *G09G 2310/0235* (2013.01); *G09G 2310/08* (2013.01); *G09G 2320/0209* (2013.01); *G09G 2320/0247* (2013.01)

(58) Field of Classification Search
CPC ... G09G 2320/0247; G09G 2320/0209; G09G 2300/0452
See application file for complete search history.

(56) References Cited

U.S. PATENT DOCUMENTS

| | | | | |
|---|---|---|---|---|
| 2009/0185091 | A1* | 7/2009 | Kim | C09K 19/02 349/39 |
| 2011/0170029 | A1* | 7/2011 | Kimura | G02F 1/136213 349/38 |
| 2013/0044281 | A1* | 2/2013 | Zhou | G02F 1/136286 349/73 |
| 2014/0240301 | A1 | 8/2014 | Yamakawa | |

FOREIGN PATENT DOCUMENTS

| | | | |
|---|---|---|---|
| KR | 101442713 | | 9/2014 |
| KR | 10-2015-0069411 | A | 6/2015 |
| KR | 10-2015-0139132 | A | 12/2015 |
| KR | 10-2016-0083325 | A | 7/2016 |

* cited by examiner

DISPLAY APPARATUS AND METHOD OF DRIVING WITH PIXELS ALTERNATIVELY CONNECTED TO ADJACENT GATE LINES

CROSS-REFERENCE TO RELATED APPLICATION

This U.S. non-provisional patent application claims priority under 35 U.S.C. § 119 of Korean Patent Application No. 10-2014-0118542, filed on Sep. 5, 2014, the contents of which are hereby incorporated by reference in its entirety.

BACKGROUND

1. Field of Disclosure

The present disclosure relates to a display apparatus and a method of driving the same. More particularly, the present disclosure relates to a display apparatus capable of improving display quality thereof and a method of driving the display apparatus.

2. Description of the Related Art

In general, a display apparatus displays various colors as combinations of the three primary colors of red, green, and blue. In such case, a display panel of the display apparatus may include red pixels, green pixels, and blue pixels. In recent years, a display apparatus that displays the various colors using another primary color in addition to the red, green, and blue colors has been developed. For example, the additional primary color may be one or more colors of magenta, cyan, yellow, and white colors.

A display apparatus that includes red, green, blue, and white pixels generally improves the brightness of a display image. The display apparatus receives red, green, and blue image signals and converts the red, green, and blue image signals to red, green, blue, and white data signals. The converted red, green, blue, and white data signals are respectively applied to corresponding red, green, blue, and white pixels. As a result, the image is displayed by the red, green, blue, and white pixels.

SUMMARY

The present disclosure provides a display apparatus that prevents or otherwise reduces a moving line-stain phenomenon, a horizontal crosstalk phenomenon, and a flicker phenomenon to improve display quality thereof.

The present disclosure also provides a method of driving the display apparatus.

Embodiments of the present system and method provide a display apparatus including a plurality of gate lines extending in a first direction, a plurality of data lines extending in a second direction crossing the first direction, and a plurality of pixels connected to the gate lines and the data lines. The pixels include pixels arranged in a k-th row and pixels arranged in a (k+1)th row. The pixels arranged in the k-th row are disposed adjacent to the pixels arranged in the (k+1)th row in the second direction such that an (i+1)th gate line of the gate line is disposed between the pixels arranged in the k-th row and the pixels arranged in the (k+1)th row. Each of i and k is a natural number. A first pixel arranged in a g-th column among the pixels arranged in the k-th row and a second pixel arranged in the g-th column among the pixels arranged in the (k+1)th row are connected to a j-th data line. Each of g and j is a natural number. The pixels arranged in the k-th row are alternately connected to an i-th gate line and the (i+1)th gate line.

Each of the pixels may display one of red, green, blue, white, yellow, cyan, and magenta colors.

The pixels may be grouped into a plurality of first pixel groups and a plurality of second pixel groups, and the first pixel groups may be alternately arranged with the second pixel groups in the first and second directions.

The first pixel groups may be applied with data voltages having different polarities from the second pixel groups in each of the k-th row and the (k+1)th row.

Each of the first and second pixel groups may include 2h pixels, in which case h is a natural number.

Each of the first pixel groups may include two pixels among red, green, blue, and white pixels, and each of the second pixel groups may include the other two pixels among the red, green, blue, and white pixels.

Each of the first pixel groups may include the red pixel displaying a red color and the green pixel displaying a green color.

Each of the second pixel groups may include the blue pixel displaying a blue color and the white pixel displaying a white color.

The pixels arranged in the k-th row may be alternately connected to the i-th gate line and the (i+1)th gate line every 41 (1 is a natural number) pixels, and the pixels arranged in the (k+1)th row may have the same connection structure as the pixels arranged in the k-th row.

Adjacent pixels in each group of 41 pixels may be alternately connected to the i-th gate line and (i+1)th gate line after every one pixel.

For each group of 41 adjacent pixel columns, a connection structure of the gate lines and the data lines of a first set of pixels applied with data voltages having a positive polarity may be the same as that of a second set of pixels PX applied with data voltages having a negative polarity, and the first set of pixels may display the same color as the second set of pixels.

The data lines may receive data voltages having different polarities from each other every two data lines.

The polarity of the data voltages may be inverted every frame period. Each group of 41 (1 is a natural number) adjacent pixels arranged in the k-th row may be connected to the i-th gate line and the (i+1)th gate line in a same configuration, and the pixels arranged in the (k+1)th row may have the same connection structure as the pixels arranged in the k-th row.

Among each group of 41 adjacent pixels, the pixels arranged in the g-th column and the (g+3)th column may be connected to the (i+1)th gate line, and the pixels arranged in the (g+1)th column and the (g+2)th column may be connected to the i-th gate line.

The number of pixels applied with the data voltages having a positive polarity may be equal to a number of pixels applied with the data voltages having a negative polarity for each row of pixels connected to the same gate line.

Embodiments of the present system and method also provide method of driving a display apparatus, including applying gate signals to a plurality of pixels grouped into a plurality of first pixel groups and a plurality of second pixel groups through gate lines extending in a first direction and applying data voltages to the pixels through data lines extending in a second direction crossing the first direction. The applying of the data voltages includes applying the data voltages having different polarities to the first and second pixel groups arranged in the first direction. The pixels include pixels arranged in a k-th row and pixels arranged in a (k+1)th row. The pixels arranged in the k-th row are disposed adjacent to the pixels arranged in the (k+1)th row in the second direction such that an (i+1)th gate line of the gate line is disposed between the pixels arranged in the k-th row and the pixels arranged in the (k+1)th row. Each of i and k is a natural number. A first pixel arranged in a g-th column among the pixels arranged in the k-th row and a second pixel arranged in the g-th column among the pixels arranged in the (k+1)th row are connected to a j-th data line. Each of g and j is a natural number. The pixels arranged in the k-th row are alternately connected to an i-th gate line and the (i+1)th gate line.

According to the above, a moving line-stain phenomenon, a horizontal crosstalk phenomenon, and a flicker phenomenon of the display apparatus is prevented or otherwise reduced to improve the display quality of the display apparatus.

BRIEF DESCRIPTION OF THE DRAWINGS

The above and other advantages of the present disclosure are described below with reference to the accompanying drawings wherein.

DETAILED DESCRIPTION

Figure 1:
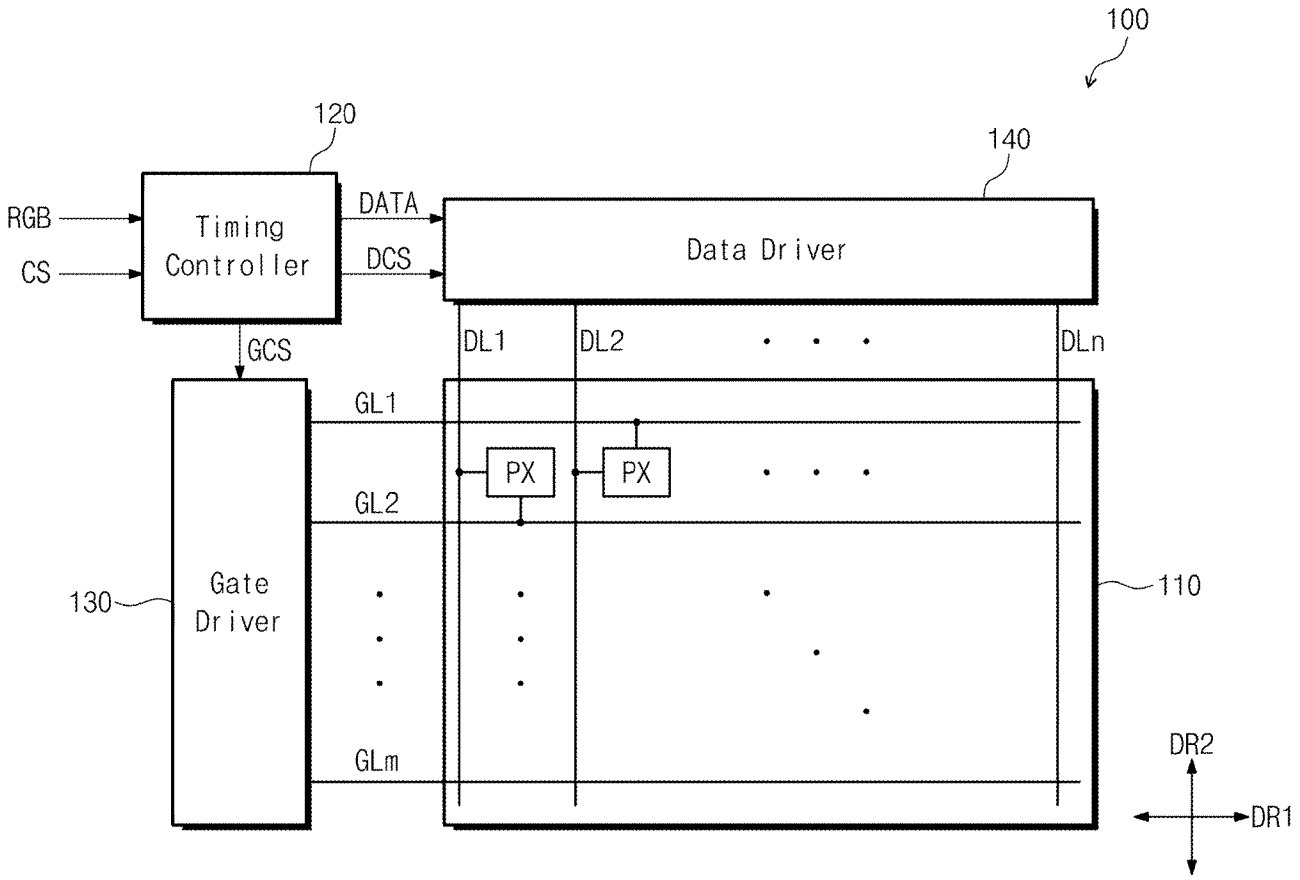
FIG. 1 is a block diagram showing a display apparatus according to an exemplary embodiment of the present disclosure.

It is understood that when an element or layer is referred to as being "on", "connected to" or "coupled to" another element or layer, it may be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It is understood that, although the terms "first," "second," etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below may be equally referred to as a second element, component, region, layer or section without departing from the teachings of the present system and method.

Spatially relative terms, such as "beneath", "below", "lower", "above", "upper" and the like, may be used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" may be construed to mean "above," depending on the orientation of the device relative to that shown in the figures. Accordingly, the spatially relative descriptors used herein are to be interpreted relative to the orientation shown in the figures.

The terminologies used herein for describing the particular embodiments are not intended to be limiting of the present system and method. As used herein, the singular forms, "a", "an" and "the" are intended to include the plural forms as well, unless the context clearly indicates otherwise. It is further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof. Unless otherwise defined, all terms (including technical and scientific terms) used herein have the meaning as commonly understood by one of ordinary skill in the art to which the present system and method belong.

Hereinafter, the present system and method are explained in detail with reference to the accompanying drawings. FIG. 1 is a block diagram showing a display apparatus according to an exemplary embodiment of the present disclosure. Referring to FIG. 1, the display apparatus 100 includes a display panel 110, a timing controller 120, a gate driver 130, and a data driver 140.

The display panel 110 may be, but not limited to, a liquid crystal display panel configured to include two substrates facing each other and a liquid crystal layer interposed between the two substrates. The display panel 110 includes a plurality of gate lines GL1 to GLm, a plurality of data lines DL1 to DLn, and a plurality of pixels PX.

The gate lines GL1 to GLm extend in a first direction DR1 and is connected to the gate driver 130. The data lines DL1 to DLn extend in a second direction DR2 crossing the first direction DR1 and is connected to the data driver 140. Each of "m" and "n" is a natural number. The first direction DR1 corresponds to a row direction and the second direction DR2 corresponds to a column direction.

The pixels PX are arranged in regions defined by the gate lines GL1 to GLm and the data lines DL1 to DLn crossing the gate lines GL1 to GLm. As FIG. 1 shows, the pixels PX are arranged in a matrix form. Each pixel PX is connected to a corresponding gate line of the gate lines GL1 to GLm and a corresponding data line of the data lines DL1 to DLn. Connections between the pixels PX and the gate lines GL1 to GLm and between the pixels PX and the data lines DL1 to DLn are described later with reference to FIG. 3.

Each pixel PX may display a primary color. For example, in the embodiment of FIG. 3, the primary colors include red, green, blue, and white. The present system and method, however, are not limited thereto. The primary colors may further include various colors, e.g., cyan, magenta, yellow, etc.

The timing controller 120 receives image signals RGB and control signals CS from an external system board (not shown). The control signals CS may include a vertical synchronization signal as a frame distinction signal, a horizontal synchronization signal as a row distinction signal, a data enable signal, and a main clock signal. The data enable signal may be maintained at a high level during a period in which the data are being output by the external system board to indicate a data input period.

The timing controller 120 may convert the data format of the image signals RGB to a data format that is appropriate for interfacing between the timing controller 120 and the data driver 140. The timing controller 120 applies output data DATA having the converted data format to the data driver 140.

The timing controller 120 generates a gate control signal GCS and a data control signal DCS in response to the control signals CS. The gate control signal GCS is used to control the operational timing of the gate driver 130. The data control signal DCS is used to control the operational timing of the data driver 140.

The gate control signal GCS may include a scan start signal indicating the start of scanning, at least one clock signal controlling the output period of a gate-on voltage, and an output enable signal controlling the gate-on voltage.

The data control signal DCS may include a horizontal start signal indicating the start of the transmission of the image data signal DATA to the data river 140, a load signal indicating the application of data voltages to the data lines DL1 to DLn, and a polarity control signal controlling the polarity of the data voltages with respect to a common voltage.

The timing controller 120 applies the gate control signal GCS to the gate driver 130 and applies the data control signal DCS to the data driver 140.

The gate driver 130 generates gate signals in response to the gate control signal GCS. The gate driver 130 may sequentially output the gate signals such the gate signals are applied to the pixels through the gate lines GL1 to GLm one row at a time.

The data driver 140 generates the data voltages in analog form based on the image data signal DATA in response to the data control signal DCS. The data voltages are applied to the pixels PX through the data lines DL1 to DLn.

The polarity of the data voltages applied to the pixels PX may be inverted every frame period to prevent the liquid crystals from burning or deteriorating. For instance, the data driver 140 may invert the polarity of the data voltages every frame period in response to the polarity control signal. In addition, when an image corresponding to one frame is displayed, data voltages having opposite polarities every two data lines may be output to the pixels to improve display quality.

The pixels PX receive the data voltages through the data lines DL1 to DLn in response to the gate signals applied thereto through the gate lines GL1 to GLm. The pixels PX display gray scales corresponding to the data voltages, and thereby display an image.

The timing controller 120 may be mounted on a printed circuit board in an integrated circuit chip and connected to the gate driver 130 and the data driver 140. The gate driver 130 and the data driver 140 may be integrated into a plurality of driving chips, mounted on a flexible printed circuit board, and connected to the display panel 110 with a tape carrier package method. The present system and method, however, are not limited thereto.

Alternatively, the gate driver 130 and the data driver 140 may be mounted on the display panel 110 with a chip-on-glass (COG) method after being integrated into the plurality of driving chips. The gate driver 130 may be formed substantially simultaneously with transistors of the pixels PX, and then mounted on the display panel 110 with an amorphous silicon TFT gate driver circuit (ASG) method.

Figure 2:
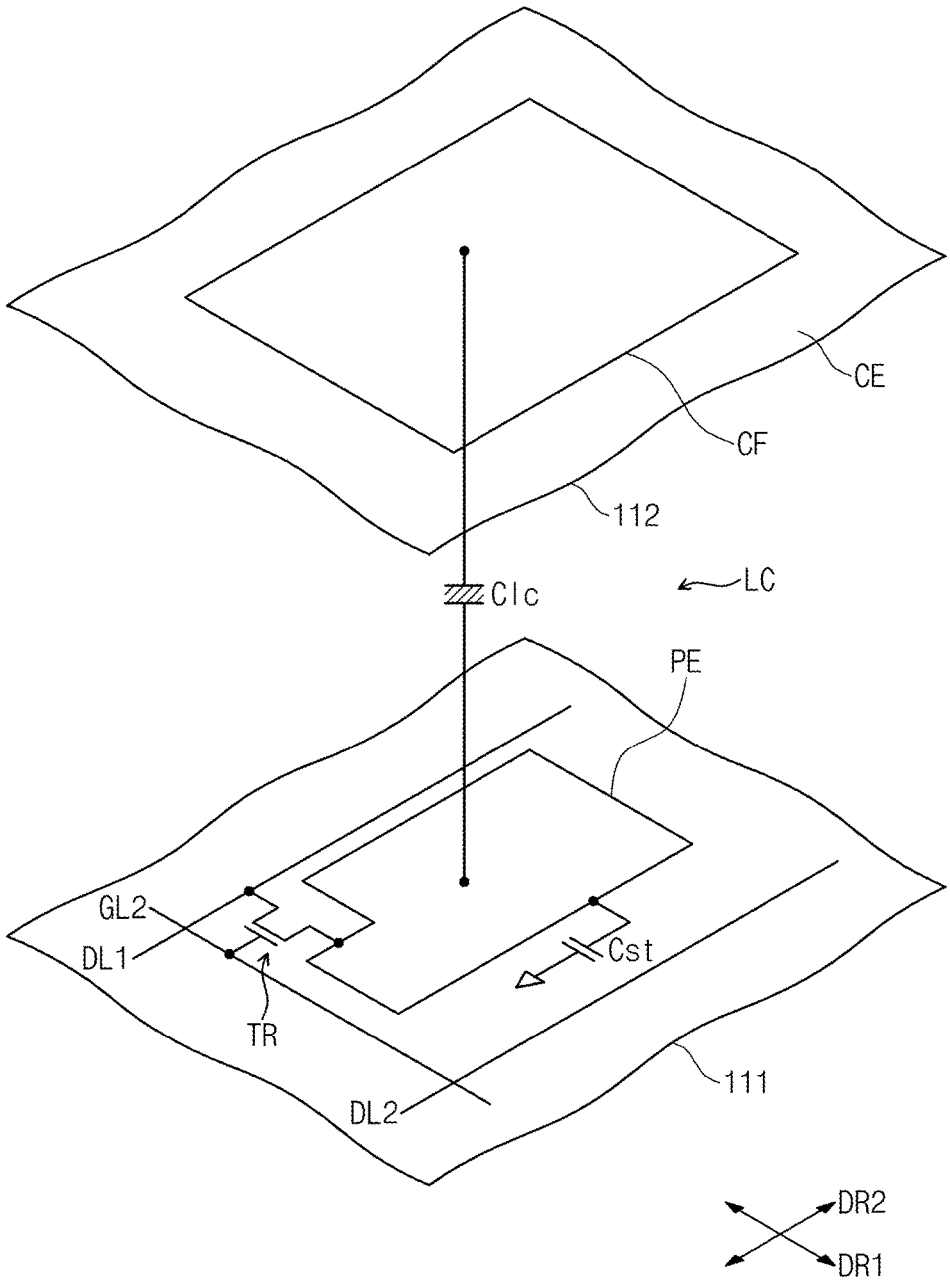
FIG. 2 is a circuit diagram of one pixel shown in FIG. 1.

FIG. 2 is a circuit diagram of one pixel shown in FIG. 1, according to an exemplary embodiment of the present disclosure. For the convenience of explanation, FIG. 2 shows only the pixel PX connected to the second gate line GL2 and the first data line DL1. Referring to FIG. 2, the display panel 110 includes a first substrate 111, a second substrate 112 facing the first substrate 111, and a liquid crystal layer LC interposed between the first substrate 111 and the second substrate 112.

The pixel PX includes a transistor TR connected to the second gate line GL2 and the first data line DL1, a liquid crystal capacitor Clc connected to the transistor TR, and a storage capacitor Cst connected to the liquid crystal capacitor Clc in parallel. The storage capacitor Cst may be omitted.

The transistor TR is disposed on the first substrate 111. The transistor TR includes a gate electrode connected to the second gate line GL2, a source electrode connected to the first data line DL1, and a drain electrode connected to the liquid crystal capacitor Clc and the storage capacitor Cst.

The liquid crystal capacitor Clc is configured to include a pixel electrode PE disposed on the first substrate 111, a common electrode CE disposed on the second substrate 112, and the liquid crystal layer LC interposed between the pixel electrode PE and the common electrode CE. The liquid crystal layer LC serves as a dielectric substance. The pixel electrode PE is connected to the drain electrode of the transistor TR. Although the pixel electrode PE shown in FIG. 2 does not have a slit structure, the pixel PX may have a slit structure comprising a trunk portion having a cross shape and a plurality of branch portions extending from the trunk portion in a radial shape.

The common electrode CE is disposed over the entire surface of the second substrate 112, but the present system and method are not limited thereto. For example, the common electrode CE may be disposed on the first substrate 111 in some embodiments, and at least one of the pixel electrode PE and the common electrode CE may have the slit structure.

The storage capacitor Cst may include the pixel electrode PE, a storage electrode (not shown) branched from a storage line (not shown), and an insulating layer disposed between the pixel electrode PE and the storage electrode (not shown). The storage line may be disposed on the first substrate 111 and on the same layer as the gate lines GL1 to GLm, and formed simultaneously or substantially simultaneously with the gate lines GL1 to GLm. The storage electrode may partially overlap with the pixel electrode PE.

The pixel PX may further include a color filter CF that transmits light of one of the primary colors. The color filter CF is disposed on the second substrate 112 in FIG. 2, but the present system and method are not limited thereto. For example, the color filter CF may be disposed on the first substrate 111 instead of the second substrate 112.

The transistor TR is turned on when a gate signal is applied thereto through the second gate line GL2. The data voltage provided through the first data line DL1 is applied to the pixel electrode PE of the liquid crystal capacitor Clc through the turned-on transistor TR. The common electrode CE is applied with the common voltage.

Due to the voltage level difference between the data voltage and the common voltage, an electric field is generated between the pixel electrode PE and the common electrode CE. The orientation and/or arrangement of the liquid crystal molecules in the liquid crystal layer LC are determined by the electric field generated between the pixel electrode PE and the common electrode CE. By controlling the orientation and/or arrangement of the liquid crystal molecules using the electric field, the transmittance of the light incident to the liquid crystal layer LC is controlled to display the image. Although not shown in figures, a backlight unit may be disposed at a rear side of the display panel 110 to provide the display panel 110 with the light.

A storage voltage having a constant voltage level may be applied to the storage line. For example, the common voltage may be applied to the storage line. The storage capacitor Cst compensates for the slow charging rate of the liquid crystal capacitor Clc.

Figure 3:
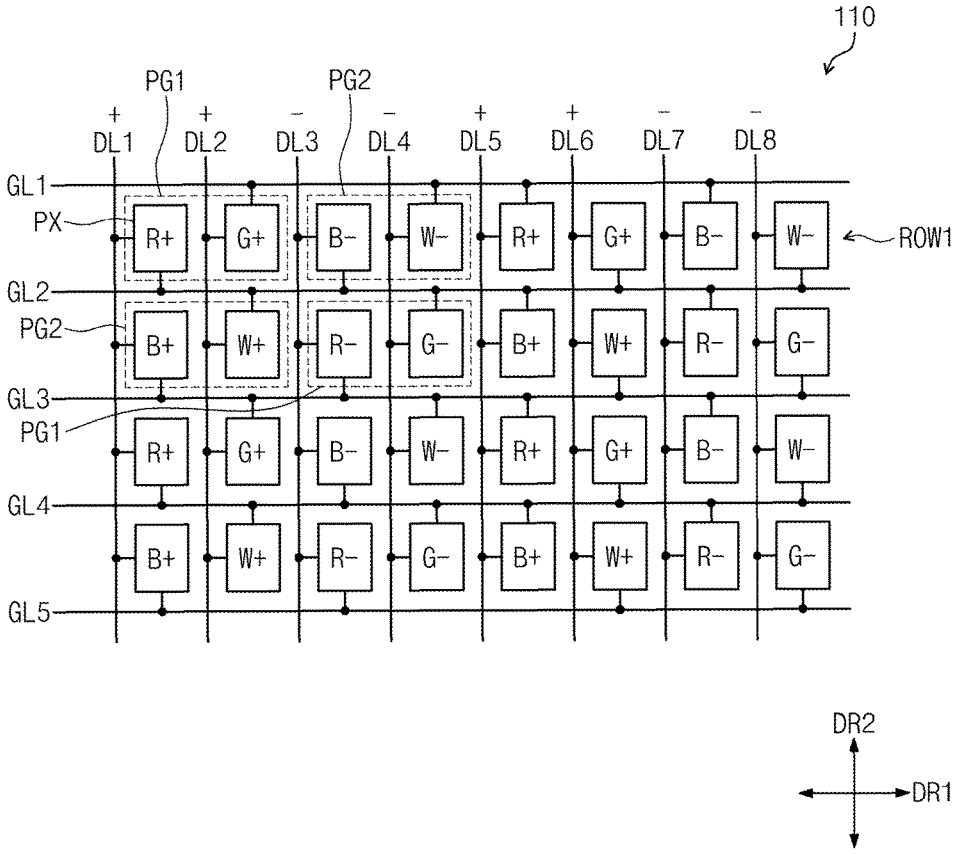
FIG. 3 is a plan view showing a portion of a display panel according to an exemplary embodiment of the present disclosure.

FIG. 3 is a plan view showing a portion of a display panel according to an exemplary embodiment of the present disclosure. FIG. 3 shows the pixels PX connected to first to fifth gate lines GL1 to GL5 and first to eighth data lines DL1 to DL8. For the convenience of explanation, red, green, blue, and white pixels are indicated by "R", "G", "B", and "W", respectively, in FIG. 3.

In FIG. 3, the pixels PX that receive data voltages having a positive (+) polarity during a first frame period are represented by "R+", "G+", "B+", and "W+", respectively, and the pixels PX that receive data voltages having a negative (−) polarity during the first frame period are represented by "R−", "G−", "B−", and "W−", respectively.

Referring to FIG. 3, the pixels PX include the red pixels R displaying the red color, the green pixels G displaying the green color, the blue pixels B displaying the blue color, and the white pixels W displaying the white color. The present system and method, however, are not limited thereto. The pixels PX may further include yellow, cyan, and magenta pixels that display yellow, cyan, and magenta colors, respectively.

The pixels PX in FIG. 3 are grouped into first pixel groups PG1 and second pixel groups PG2. The first pixel groups PG1 are alternately arranged with the second pixel groups PG2 in the first and second directions DR1 and DR2.

Each of the first and second pixel groups PG1 and PG2 includes 2h pixels PX, where "h" is a natural number. In the exemplary embodiment of FIG. 3, the "h" is 1, and therefore, each of the first and second pixel groups PG1 and PG2 includes two pixels PX.

Each of the first pixel groups PG1 includes two pixels of the red, green, blue, and white pixels R, G, B, and W and each of the second pixel groups PG2 includes the other two pixels of the red, green, blue, and white pixels R, G, B, and W. In the case of FIG. 3, each of the first pixel groups PG1 includes the red and green pixels R and G, and each of the second pixel groups PG2 includes the blue and white pixels B and W. However, the arrangement of the pixels PX is not limited to the arrangement shown in FIG. 3.

For instance, in another embodiment, each of the first pixel groups PG1 may include the red and blue pixels R and B, and each of the second pixel groups PG2 may include the green and white pixels G and W. In yet another embodiment, each of the first pixel groups PG1 may include the red and white pixels R and W, and each of the second pixel groups PG2 may include the green and blue pixels G and B.

The pixels PX arranged in the same column are connected to a corresponding data line of the first to eighth data lines DL1 to DL8. For instance, the pixels PX arranged in a g-th column are connected to a j-th data line. Each of "g" and "j" is a natural number.

The pixels PX arranged in a k-th row between an i-th gate line and an (i+1)th gate line are alternately connected to the i-th gate line and the (i+1)th gate line every 41 pixels, where "l" is a natural number. Furthermore, the pixels X within a group of 41 adjacent pixels, starting from the first pixel column, are alternately connected to the i-gate line and the (i+1)th gate line after every one pixel. The pixels arranged in each column have the same connection structure. For example, each pixel in the first pixel column of FIG. 3 is connected to the data line on the left side and the gate line below, each pixel in the second column is connected to the data line to the left and the gate line above, and so on.

When each of "l" and "k" is 1, the pixels PX arranged in a first row ROW1 are alternately connected to the first and second gate lines GL1 and GL2 every four pixels PX. In addition, the four pixels PX in each group of four adjacent pixels PX, starting from the first column, are alternately connected to the first and second gate lines GL1 and GL2 after every one pixel.

For instance, the first to fourth pixels PX arranged in the first row ROW1 of FIG. 3 are connected the second gate line GL2, the first gate line GL1, the second gate line GL2, and the first gate line GL1, respectively. Also, because connection to the gate lines GL1 and GL2 alternate every four (when l=1) pixels, the pixel fifth to eighth pixels PX arranged in the first row ROW1 are connected to the first gate line GL1, the second gate line GL2, the first gate line GL1, and the second gate line GL2, respectively. The pixels PX arranged in the other rows are connected to corresponding gate lines of the gate lines GL2 to GLm in the same way as the pixels PX arranged in the first row ROW1.

Due to the connection structure of the pixels PX described above, like-colored pixels PX of adjacent first pixel groups PG1 arranged in the k-th row have opposite connection structures with respect to the gate lines. Likewise, like-colored pixels PX of adjacent second pixel groups PG2 arranged in the k-th row have opposite connection structures with respect to the gate lines.

For instance, when the "i" and "k" is 1, the red and green pixels R+ and G+ of the first first-pixel group PG1 (i.e., pixel columns one and two) of the first row ROW1 shown in FIG. 3 are respectively connected to the second gate line GL2 and the first gate line GL1. In addition, the red and green pixels R+ and G+ of the second first-pixel group PG1 (i.e., pixel columns five and six) of the first row ROW1 shown in FIG. 3 are respectively connected to the first gate line GL1 and the second gate line GL2.

The polarity of the data voltages applied to the first to eighth data lines DL1 to DL8 is inverted every two data lines. For instance, first, second, fifth, and sixth data lines DL1, DL2, DL5, and DL6 are applied with data voltages having the positive (+) polarity and third, fourth, seventh, and eighth data lines DL3, DL4, DL7, and DL8 are applied with data voltages having the negative (−) polarity as shown in FIG. 3.

In this case, the first and second pixel groups PG1 and PG2 arranged in the k-th row receive different data voltages from each other. For example, when the "k" is 1, the first pixel groups PG1 arranged in the first row ROW1 receive the data voltages having the positive (+) polarity through the first, second, fifth, and sixth data lines DL1, DL2, DL5, and DL6. The second pixel groups PG2 arranged in the first row ROW1 receive the data voltages having the negative (−) polarity through third, fourth, seventh, and eighth data lines DL3, DL4, DL7, and DL8.

The polarities of the data voltages applied to the pixels PX of the display panel 110 shown in FIG. 3 indicate polarities in the first frame period. As described above, the data driver 140 inverts the polarities of the data voltages every frame period. Therefore, the polarities of the data voltages applied to the pixels PX are inverted in a next frame period.

To provide a comparison to the display panel 110 shown in FIG. 3, consider a display panel in which pixels arranged in the same row are connected to the same gate line and pixels arranged in the same column are connected to the same data line. Hereinafter, such a display panel is referred to as a comparison display panel.

In the comparison display panel, the red pixels arranged in the first, third, fifth, and seventh columns are operated during a first frame period, and the red pixels arranged in fifth, seventh, ninth, and eleventh columns are operated in the next frame period to display a red image.

In addition, data voltages repeatedly having the polarities of +, −, +, −, −, +, −, and + are applied to the pixels through the data lines during the first frame period, and data voltages repeatedly having the polarities of −, +, −, +, +, −, +, and − are applied to the pixels through the data lines during the next frame period. Thus, in the first period, the red pixels arranged in the first and third columns are operated by data voltages having the positive (+) polarity and the red pixels arranged in the fifth and seventh columns are operated by data voltages having the negative (−) polarity.

Hereinafter, the pixels displaying the same color are referred to as the "same pixels." The red pixels arranged in the first column and the red pixels arranged in the fifth column are operated by data voltages having opposite polarities to each other as the same pixels arranged in the same row. In addition, the red pixels arranged in the third column and the red pixels arranged in the seventh column are operated by data voltages having opposite polarities to each other as the same pixels arranged in the same row. That is, the red pixels arranged in the same row are alternately applied with data voltages having opposite polarities to each other.

In addition, during the next frame period, the red pixels arranged in the fifth and seventh columns are operated by data voltages having the positive (+) polarity and the red pixels arranged in the ninth and eleventh columns are operated by data voltages having the negative (−) polarity.

In this case, a difference in brightness occurs between the red pixel applied with the data voltage having the positive (+) polarity and the red pixel applied with the data voltage having the negative (−) polarity. As such, an image in which a vertical line moves may be perceived when the frame period is changed from the first frame period to the next frame period. This phenomenon in which the vertical line moves is hereinafter referred to as a "moving line-stain phenomenon." The moving line-stain phenomenon may also occur when all the pixels are operated, e.g., a full white mode, and not just when a specific color is displayed. The moving line-stain phenomenon, however, may be prevented or otherwise reduced when the pixels PX arranged in the same row receive data voltages having the same polarity, such as that shown in FIG. 3 when the red pixels R+ arranged in the first row ROW1 receive data voltages having the positive (+) polarity in the first frame.

Figure 4:
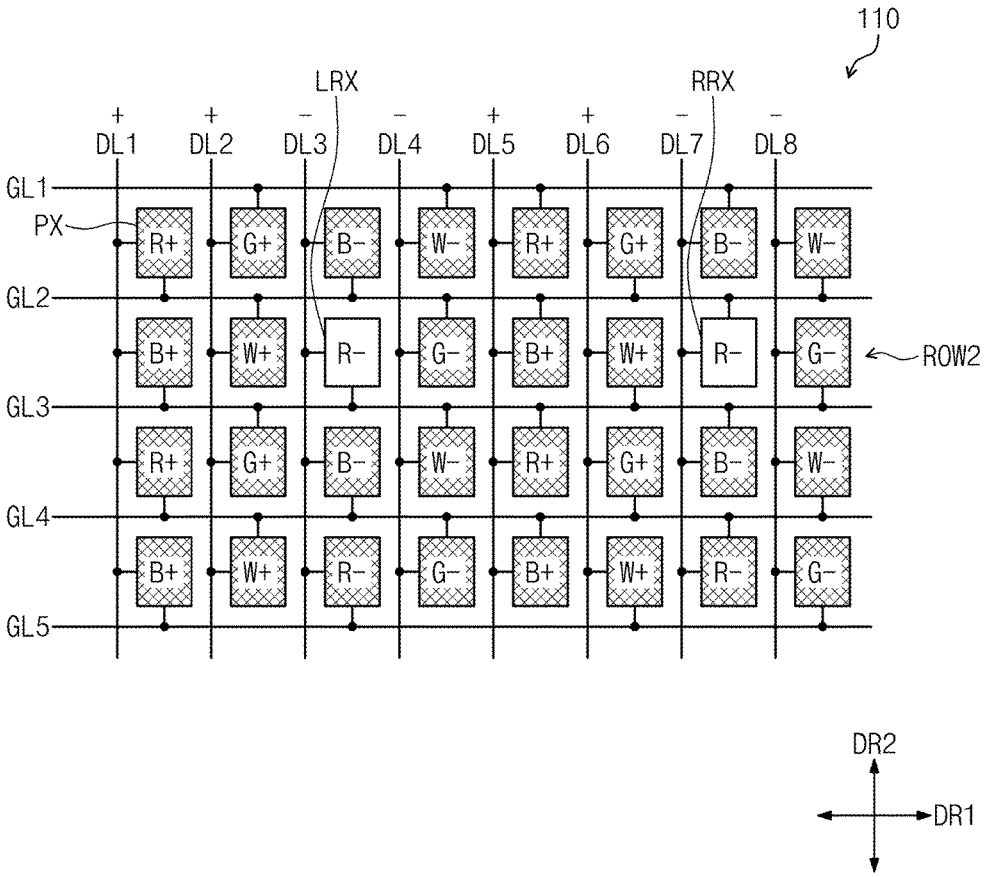
FIG. 4 is a view showing the driving state of a row of the pixels in FIG. 3 when a primary color is displayed, according to an exemplary embodiment of the present disclosure.

FIG. 4 is a view showing the driving state of a row of the pixels in FIG. 3 when a primary color is displayed, according to an exemplary embodiment of the present disclosure. Particularly, the operation of the red pixels R− arranged in the second row ROW2 when displaying the red color is described.

Referring to FIG. 4, among the eight pixels PX arranged in the second row ROW2, two red pixels R− are operated by data voltages having the same negative (−) polarity. The other pixels PX arranged in the second row ROW2 are operated to display a black gray scale.

Among the two red pixels R−, a left red pixel LRX is connected to the third gate line GL3 and the third data line DL3*m* and a right red pixel RRX is connected to the second gate line GL2 and the seventh data line DL7.

FIG. 4 shows that each of the same pixels among the eight pixels PX arranged in the same row is operated in response to the gate lines applied thereto through the corresponding gate line. For example, the left red pixel LRX receives the data voltage having the negative (−) polarity through the third data line DL3 in response to the gate signal applied thereto through the third gate line GL3. The right red pixel RRX receives the data voltage having the negative (−) polarity through the seventh data line DL7 in response to the gate signal applied thereto through the second gate line GL2.

In the above-mentioned comparison display panel, pixels in the same row are connected to the same gate line and pixels in the same column are connected to the same data line. Thus, in the case of the comparison display, the red pixels arranged in the same row are connected to the same gate line.

In addition, data voltages repeatedly having the polarities of +, −, −, +, +, −, −, and + are applied to the pixels of the comparison display panel through the data lines. Thus, the two pixels among the eight pixels arranged in the same row in the comparison display panel receive data voltages having the same polarity in response to the gate signal applied thereto through one gate line.

However, the two red pixels R− among the eight pixels PX arranged in the same row in the display panel 110 according to the exemplary embodiment of FIG. 4 receive data voltages having the same polarity in response to the gate signals applied thereto through two different gate lines. As a result, the number of the same pixels PX in the display panel 110 according to the exemplary embodiment of FIG. 3 that are arranged in the same row, connected to the same gate line, and applied with data voltages having the same polarity, is reduced to half of that of the comparison display panel.

In general, when the data voltages applied to the same pixels connected to the same gate line are maintained at the same polarity during a period in which the pixels are operated in each row, a ripple occurs in the common voltage due to a coupling phenomenon between the data lines and the common electrode. When the data voltages have the positive (+) polarity, the ripple changes the common voltage in the positive voltage direction, and when the data voltages have the negative (−) polarity, the ripple changes the common voltage in the negative voltage direction.

When the red pixel is operated to display the red color and the ripple occurs in the common voltage, a difference in brightness between a region adjacent to the red pixel in the first direction and upper and lower regions of the red pixel may be perceived. In addition, a difference in brightness between the adjacent region to the red pixel and upper and lower regions of the adjacent region may be perceived. As a result, a horizontal crosstalk phenomenon occurs.

As the number of the same pixels that are arranged in the same row, connected to the same gate line, and applied with data voltages having the same polarity increases, the rippling in the common voltage also increases, and thus the horizontal crosstalk phenomenon is intensified.

According to an exemplary embodiment of the present system and method, the number of the same pixels in the display panel 110 that are arranged in the same row, connected to the same gate line, and applied with data voltages having the same polarity, is reduced to half of that of the comparison display panel. As a result, the horizontal crosstalk phenomenon in the display panel 110 is prevented or otherwise reduced.

Figure 5:
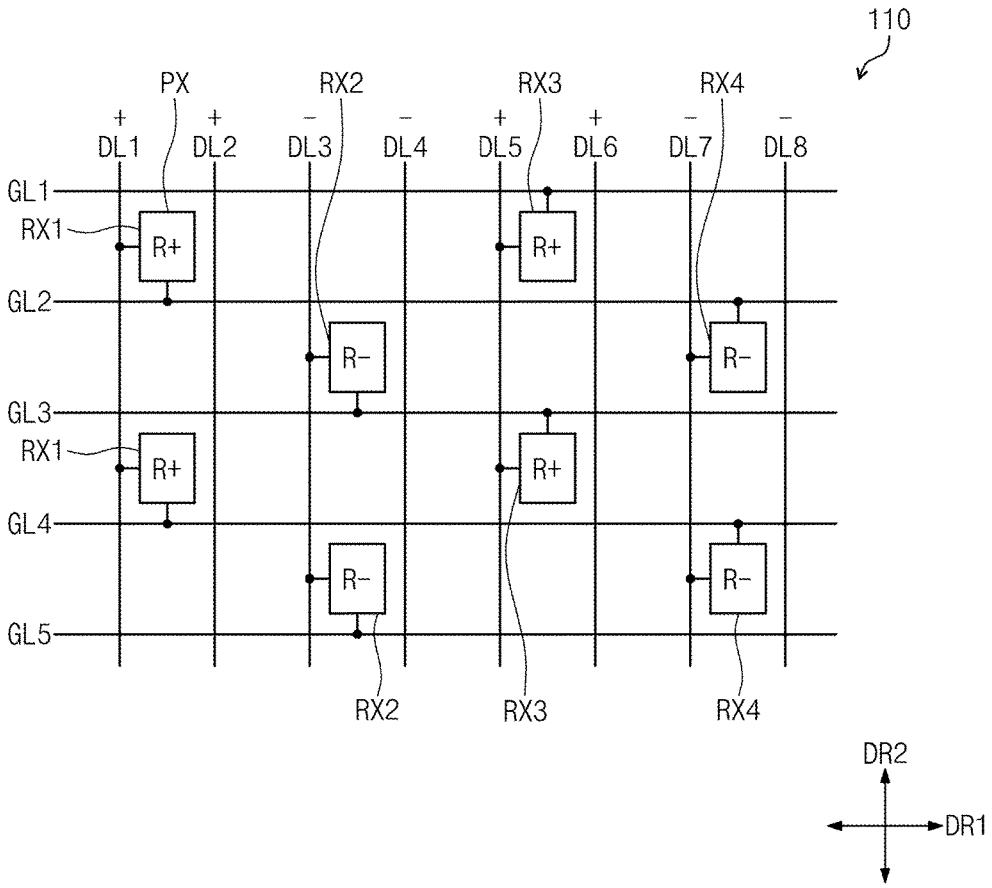
FIG. 5 is a view showing red pixels of the display panel shown in FIG. 5, according to an exemplary embodiment of the present disclosure.

FIG. 5 is a view showing the red pixels of the display panel shown in FIG. 3, according to an exemplary embodiment of the present disclosure. Referring to FIG. 5, for each group of 41 adjacent pixel columns, starting from the first pixel column, the gate-line and data-line connection structure of the pixels PX applied with data voltages having the positive (+) polarity is the same or substantially the same as that of the pixels PX having the same color but applied with data voltages having the negative (−) polarity.

For instance, when "l" is equal to 1, the red pixels R shown in FIG. 5 are divided into first, second, third, and fourth red pixels RX1, RX2, RX3, and RX4 in accordance with the gate lines and data lines connected thereto and the polarity of the data voltages applied thereto. As FIG. 5 shows, in the first four columns, the first red pixel RX1 is connected to a lower gate line (e.g., GL2 and GL4) and a left data line (e.g., DL1) and includes the red pixels R+ applied with data voltages having the positive (+) polarity. Likewise, the second red pixel RX2 is connected to a lower gate line (e.g., GL3 and GL 5) and a left data line (e.g., DL3) and includes the red pixels R− applied with data voltages having the negative (−) polarity. Accordingly, the gate-line and data-line connection structure of the first red pixel RX1 is the same or substantially the same as that of the second red pixel RX2.

In the second four column group, the third red pixel RX3 is connected to an upper gate line (e.g., GL1 and GL3) and a left data line (e.g., DL 5) and includes the red pixels R+ applied with data voltages having the positive (+) polarity. Likewise, the fourth red pixel RX4 is connected to an upper gate line (e.g., GL2 and GL4) and a left data line (e.g., DL7) and includes the red pixels R− applied with data voltages having the negative (−) polarity. Accordingly, the gate-line and data-line connection structure of the third red pixel RX3 is the same or substantially the same as that of the fourth red pixel RX4.

Two pixels connected to different gate and data lines may have transistors with different shapes from each other due to errors in the manufacturing process. As such, these transistors may also have different parasitic capacitances from each other. This means that even if the two pixels receive the same data voltage, the pixel voltages charged in the two pixels may be different from each other, and thereby display images with different brightness levels. For instance, because the first and third red pixels RX1 and RX3 have different connection structures, they may display images with different brightness levels even if the same data voltage is being applied. Furthermore, when a frame inversion driving scheme is applied and the gate-line and data-line connection structure of the pixels applied with the positive data voltage during a first frame period is different from that of the pixels applied with the negative data voltage during the first frame period, a flicker phenomenon may occur in every frame period due to the difference in brightness between the pixels.

However, the gate-line and data-line connection structure of the first red pixel RX1 applied with the positive (+) data voltage is the same or substantially the same as that of the second red pixel RX2 applied with the negative (−) data voltage. Likewise, the gate-line and data-line connection structure of the third red pixel RX3 applied with the positive (+) data voltage is the same or substantially the same as that of the fourth red pixel RX4 applied with the negative (−) data voltage. When the gate-line and data-line connection structures of the pixels PX are the same, brightness differences may not occur in every frame period, and the flicker phenomenon may be prevented from occurring in the display panel 110. Accordingly, the display apparatus 100 of the present system and method prevents the occurrence of the moving line-stain phenomenon, the horizontal crosstalk phenomenon, and the flicker phenomenon, and therefore has improved image display quality.

Figure 6:
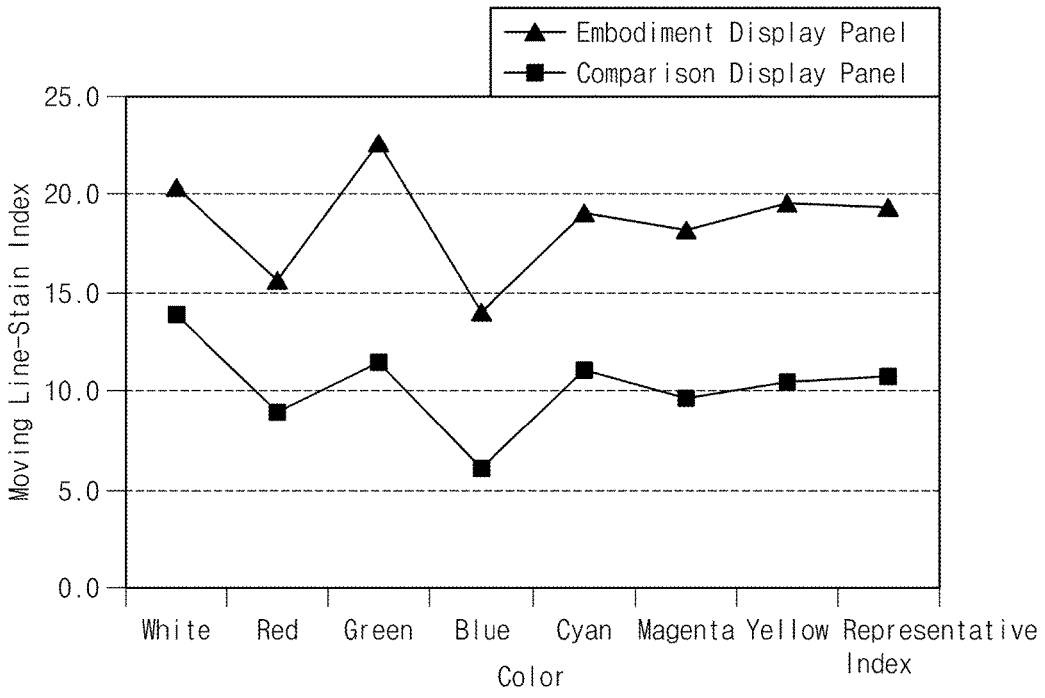
FIG. 6 is a simulated graph showing a moving line-stain index of a comparison display panel and a display panel according to an exemplary embodiment of the present disclosure.

FIG. 6 is a simulated graph showing a moving line-stain index of the comparison display panel and the display panel according to an exemplary embodiment of the present disclosure. The moving line-stain index is obtained by quantifying the degree in which the moving line-stain is perceived by human eyes. As the moving line-stain index increases, the degree in which the moving line-stain is perceived by the human eyes increases. As the moving line-stain index decreases, the degree in which the moving line-stain is perceived by the human eyes decreases.

FIG. 6 shows the moving line-stain index of each color and a representative index that corresponds to an average value of the moving line-stain indices of the colors. The moving line-stain index shown in FIG. 6 is measured under a condition in which the distance between the display panel 110 and a user is set to about 50 cm.

Referring to FIG. 6, the moving line-stain index of the display panel 110 is lower than that of the comparison display panel for all the colors. That is, the moving line-stain phenomenon in the display apparatus 100 is diminished compared to that of the comparison display panel.

Figure 7A:
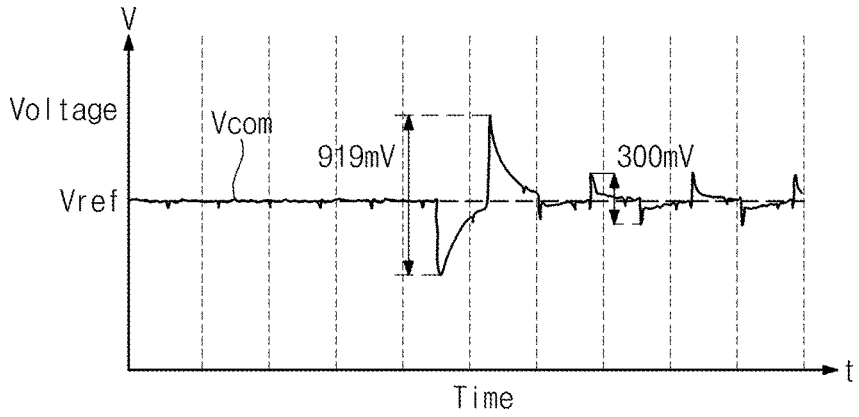
FIG. 7A is a view showing a ripple generated in a common voltage of the comparison display panel.
Figure 7B:
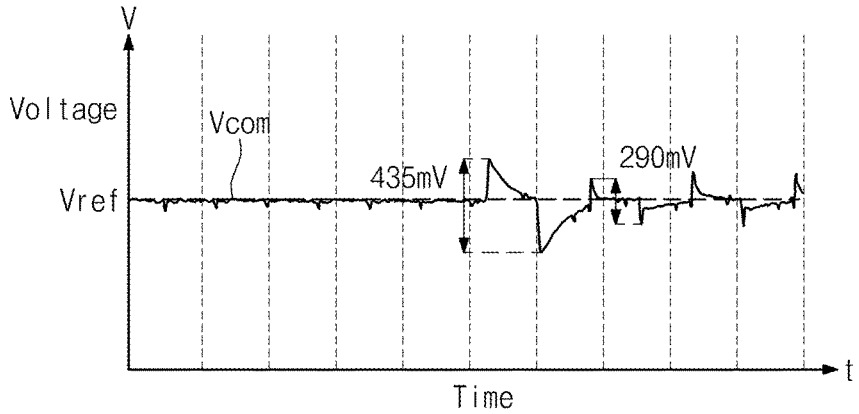
FIG. 7B is a view showing a ripple generated in a common voltage of the display panel according to an exemplary embodiment of the present disclosure.

FIG. 7A is a view showing a ripple generated in the common voltage of the comparison display panel, and FIG. 7B is a view showing a ripple generated in the common voltage of the display panel according to an exemplary embodiment of the present disclosure.

Referring to FIGS. 7A and 7B, the common voltage VCOM applied to the common electrode CE has a uniform reference voltage level Vref. However, rippling occurs in the common voltage VCOM due to a coupling phenomenon between the common electrode CE and the data lines DL1 to DLn.

As shown in FIG. 7A, the ripple of the common voltage VCOM in the comparison display panel has a level of about 300 mV to about 919 mV, but the ripple of the common voltage VCOM in the display panel 110 according to the exemplary embodiment has a level of about 290 mV to about 435 mV as shown in FIG. 7B. That is, the ripple of the common voltage VCOM in the display panel 110 is smaller than the ripple of the common voltage VCOM in the comparison display panel. As such, the horizontal crosstalk phenomenon is diminished in the display apparatus 100.

Figure 8:
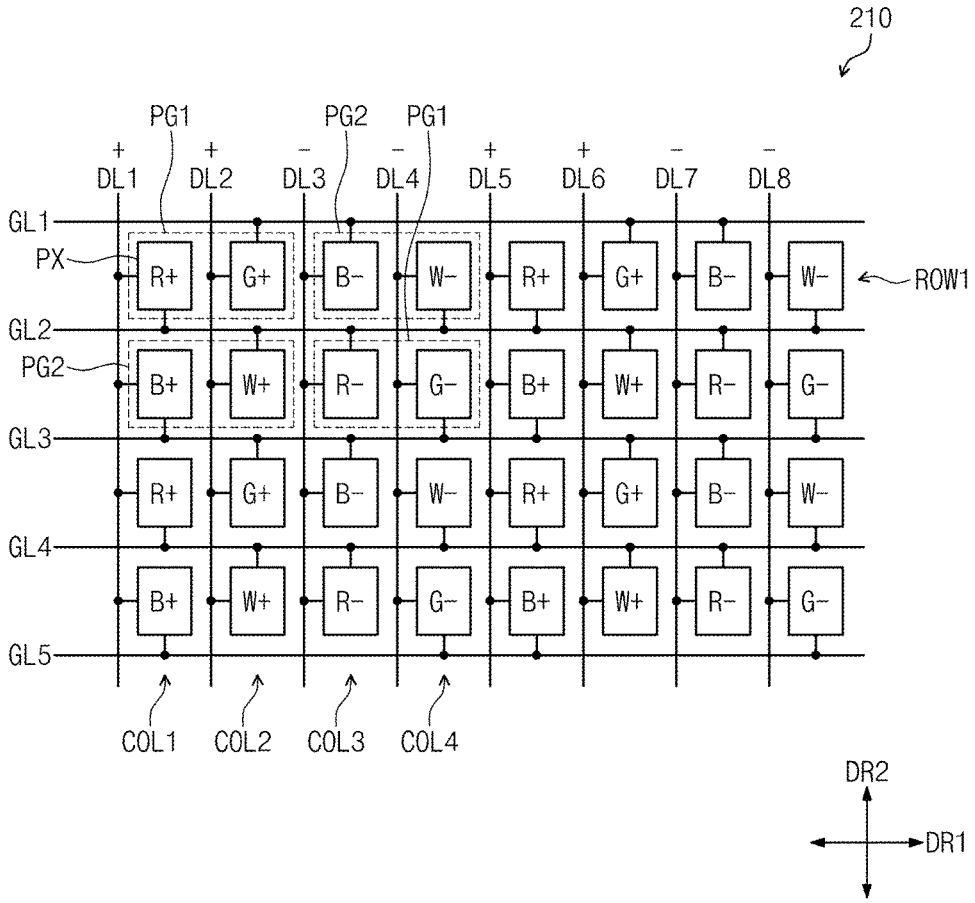
FIG. 8 is a plan view showing a portion of a display apparatus according to another exemplary embodiment of the present disclosure.

FIG. 8 is a plan view showing a portion of a display apparatus according to another exemplary embodiment of the present disclosure. The display apparatus of FIG. 8 differs from the display apparatus of FIG. 1 at least in the connection structure between the pixels PX and the gate lines GL1 to GLm and the data lines DL1 to DLn. Accordingly, hereinafter, the connection structure between the pixels PX and the gate lines GL1 to GL5 and the data lines DL1 to DL8 are described with reference to FIG. 8.

Referring to FIG. 8, first pixel groups PG1 are alternately arranged with second pixel groups PG2 in the first and second directions DR1 and DR2. The pixels PX are connected to corresponding data lines DL1 to DL8. Particularly, pixels in the same column are connected to the same data line.

The pixels PX arranged in a k-th row between an i-th gate line and an (i+1)th gate line are connected to the i-th gate line and the (i+1)th gate line in the same way repeated every 41 pixels PX. In each group of 41 pixels PX, the pixels PX arranged in a g-th column and a (g+3)th column are connected to the (i+1)th gate line, and the pixels PX arranged in a (g+1)th column and a (g+2)th column are connected to the i-th gate line.

For instance, when each of the "k", "i", and "g" is 1, the pixels PX arranged in the first row ROW1 between the first and second gate lines GL1 to GL2 are connected to the first and second gate lines GL1 and GL2 in the same way repeated every four pixels. In the first four pixels PX, the pixels PX arranged in the first and fourth columns COL1 and COL4 are connected to the second gate line GL2, and the pixels PX arranged in the second and third columns COL2 and COL3 are connected to the first gate line GL1.

The data lines DL1 to DL8 receive data voltages having different polarities from each other every two data lines. The positive (+) and negative (−) polarities are applied to the pixels PX through the data lines DL1 to DL8. Accordingly, the polarity of the pixels PX is inverted every two columns.

As shown in FIG. 8, the same pixels PX arranged in the same row are operated by data voltages having the same polarity. Therefore, the moving line-stain phenomenon is diminished in the display panel 210 according to the exemplary embodiment of FIG. 8.

Figure 9:
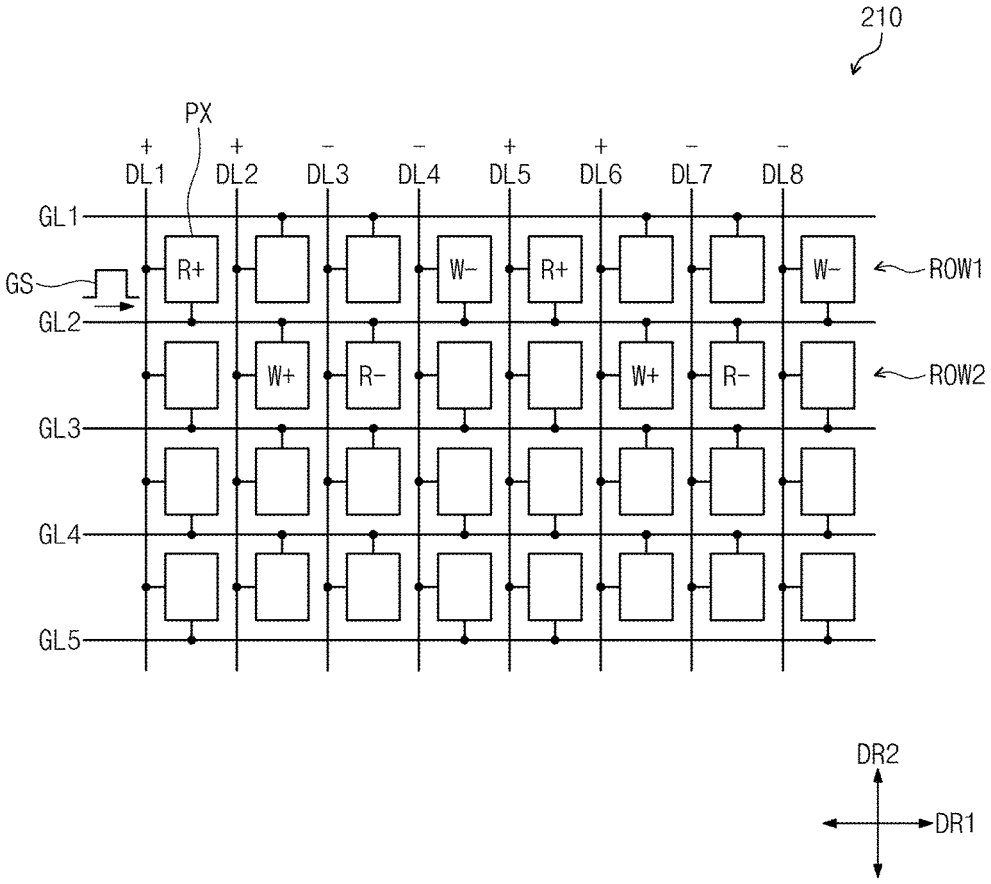
FIG. 9 is a view showing the driving state of the pixels of FIG. 8 as they are being operated by a second gate line in a full white mode, according to an exemplary embodiment of the present disclosure.

FIG. 9 is a view showing the driving state of the pixels of FIG. 8 as they are being operated by a second gate line in a full white mode, according to an exemplary embodiment of the present disclosure. Referring to FIG. 9, the display panel 210 is operated in the full white mode in which all the pixels PX are driven. That is, when the gate signal GS is applied to the pixels PX through the second gate line GL2 in the full white mode, the pixels PX connected to the second gate line GL2 are driven.

Generally, if the sum of the positive and negative polarities of the data voltages applied to the pixels PX arranged in the same row and the same gate line is biased towards the positive or negative polarity, rippling changes the common voltage in the positive or negative voltage direction, respectively.

In the case of FIG. 9, the data voltages applied to the pixels PX arranged in the first row ROW1 and connected to the second gate line GL2 include two positive (+) data voltages and two negative (−) data voltage, and the data voltages applied to the pixels PX arranged in the second row ROW2 and connected to the second gate line GL2 include two positive (+) data voltages and two negative (−) data voltage. Because the number of pixels PX applied with the positive (+) data voltages is equal to the number of pixels PX applied with the negative (−) data voltages for each row of pixels connected to the same gate line, the sum of the positive and negative polarities of the data voltages applied to the pixels PX connected to the second gate line GL2 is unbiased. As such, rippling does not occur in the common voltage, and horizontal crosstalk phenomenon is prevented or otherwise reduced in the display panel 210 of FIGS. 8 and 9, thereby improving the display quality of the display apparatus.

Figure 10:
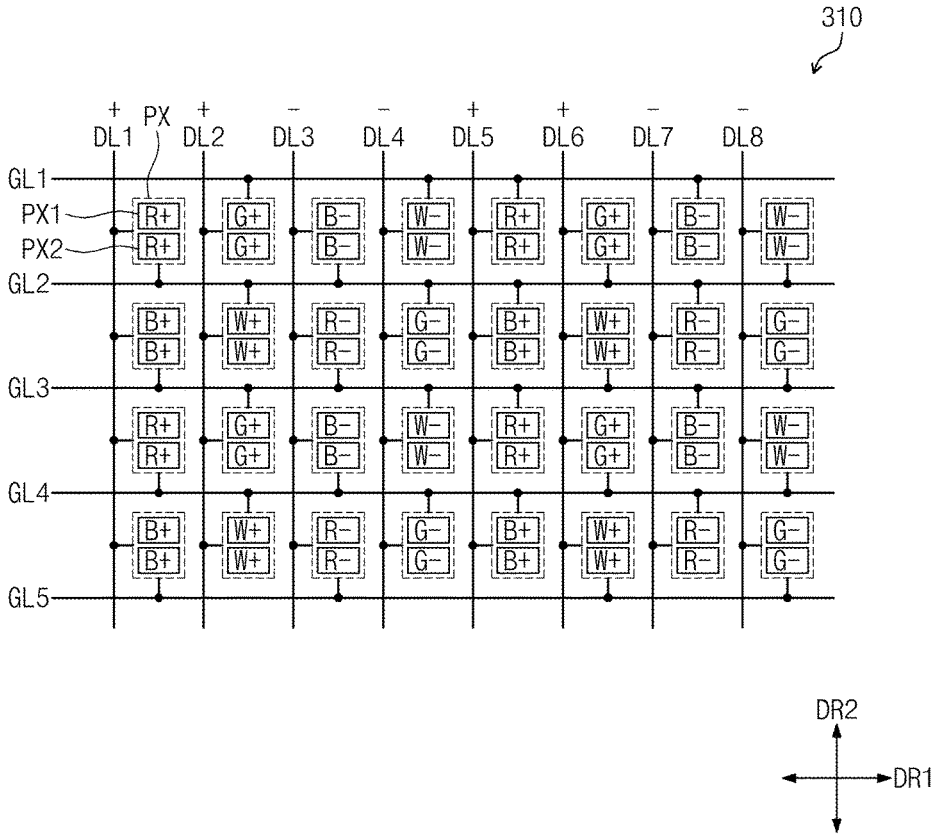
FIG. 10 is a plan view showing a portion of a display panel according to an exemplary embodiment of the present disclosure.

FIG. 10 is a plan view showing a portion of a display panel 310 according to an exemplary embodiment of the present disclosure. Referring to FIG. 10, the display panel 310 includes a plurality of pixels PX. The first and second sub-pixels PX1 and PX2 are connected to the same gate line and the same data line, and therefore, receive the same data voltage having the same polarity. The first and second sub-pixels PX1 and PX2, however, are charged with pixel voltages having different voltage levels and display images having different gray scales. As such, the human eyes recognize an intermediate value between two pixel voltages.

The display apparatus 310 prevents or otherwise reduces deterioration of the side surface viewing angle caused by the distortion of a gamma curve below the intermediate gray scale level. That is, because the first and second sub-pixels PX1 and PX2 are charged with the pixel voltages having different voltage levels, visibility of the display apparatus 310 is improved.

The gate-line and data-line connection structure of the pixels PX shown in FIG. 10 is the same or substantially the same as that of the pixels PX shown in FIG. 3. The difference between the structure of FIG. 10 and that of FIG. 3 is the inclusion of the first and second sub-pixels PX1 and PX2 shown in FIG. 10, hereinafter referred to as the "visibility structure." The visibility structure may be applied to the display panels 110 and 210 respectively shown in FIGS. 3 and 8.

Figure 11:
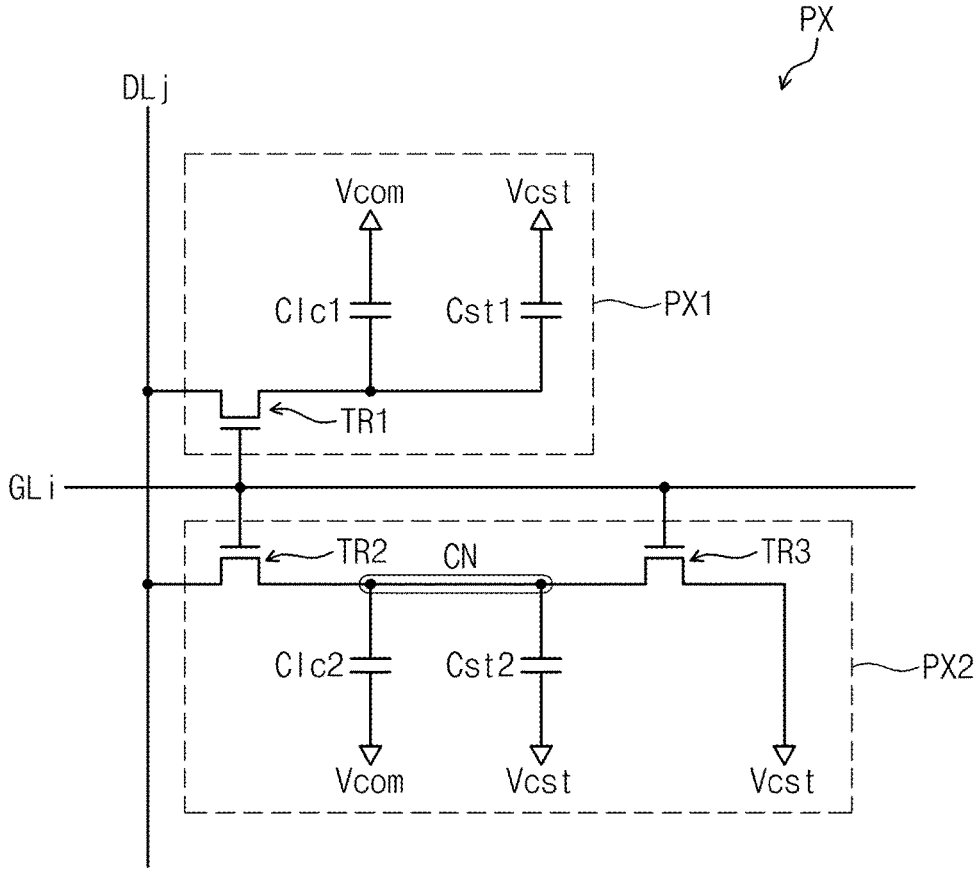
FIG. 11 is a circuit diagram of one pixel shown in FIG. 10, according to an exemplary embodiment of the present disclosure.

FIG. 11 is a circuit diagram of one pixel shown in FIG. 10, according to an exemplary embodiment of the present disclosure. Referring to FIG. 11, the pixel PX includes the first and second sub-pixels PX1 and PX2. The first sub-pixel PX1 includes a first transistor TR1, a first liquid crystal capacitor Clc1, and a first storage capacitor Cst1. The second sub-pixel PX2 includes a second transistor TR2, a third transistor TR3, a second liquid crystal capacitor Clc2, and a second storage capacitor Cst2.

The first transistor TR1 includes a gate electrode connected to an i-th gate line GLi, a source electrode connected to a j-th data line DLj, and a drain electrode connected to the first liquid crystal capacitor Clc1 and the first storage capacitor Cst1.

The first liquid crystal capacitor Clc1 includes a first electrode connected to the drain electrode of the first transistor TR1 and a second electrode applied with a common voltage Vcom. The first storage capacitor Cst1 includes a first electrode connected to the drain electrode of the first transistor TR1 and a second electrode applied with a storage voltage Vcst.

The second transistor TR2 includes a gate electrode connected to the i-th gate line GLi, a source electrode connected to the j-th data line DLj, and a drain electrode connected to the second liquid crystal capacitor Clc2 and the second storage capacitor Cst2.

The second liquid crystal capacitor Clc2 includes a first electrode connected to the drain electrode of the second transistor TR2 and a second electrode applied with the common voltage Vcom. The second storage capacitor Cst1 includes a first electrode connected to the drain electrode of the second transistor TR2 and a second electrode applied with the storage voltage Vcst.

The third transistor TR3 includes a gate electrode connected to the i-th gate line GLi, a source electrode applied with the storage voltage Vcst, and a drain electrode connected to the drain electrode of the second transistor TR2. That is, the drain electrode of the third transistor TR3 is connected to the first electrode of the second liquid crystal capacitor Clc2.

The first to third transistors TR1 to TR3 are turned on in response to a gate signal applied thereto through the i-th gate line GLi. A data voltage provided through the j-th data line DLj is applied to the first sub-pixel PX1 through the turned-on first transistor TR1. The first liquid crystal capacitor Clc1 is charged with a first pixel voltage corresponding to the difference in level between the data voltage and the common voltage Vcom.

The data voltage provided through the j-th data line DLj is applied to the second sub-pixel PX2 through the turned-on second transistor TR2. That is, the data voltage provided through the j-th data line DLj is applied to the second liquid crystal capacitor Clc2 through the second transistor TR2.

The turned-on third transistor TR3 receives the storage voltage Vcst and applies the storage voltage Vcst to the second sub-pixel PX2. That is, the storage voltage Vcst is applied to the second liquid crystal capacitor Clc2 through the third transistor TR3.

The data voltage has one of the positive and negative polarities. The common voltage Vcom may have the same or substantially the same voltage level as that of the storage voltage Vcst.

The voltage at a contact node CN where the drain electrode of the second transistor TR2 is connected to the drain electrode of the third transistor TR3 is determined based on the resistance value of the contact node CN when the second and third transistors TR2 and TR3 are turned on. That is, the voltage at the contact node CN is smaller than the data voltage provided through the turned-on second transistor TR2 but greater than the storage voltage Vcst provided through the turned-on third transistor TR3. The second liquid crystal capacitor Clc2 is charged with a second pixel voltage corresponding to the difference in level between the voltage of the contact node CN and the common voltage Vcom.

Since the second pixel voltage corresponds to the difference in level between the voltage of the contact node CN and the common voltage Vcom, the first pixel voltage charged in the first liquid crystal capacitor Clc1 is greater than the second pixel voltage charged in the second liquid crystal capacitor Clc2. As a result, the first pixel voltage charged in the first sub-pixel PX1 is different from the second pixel voltage charged in the second sub-pixel PX2, and thus the visibility of the display apparatus is improved.

Figure 12:
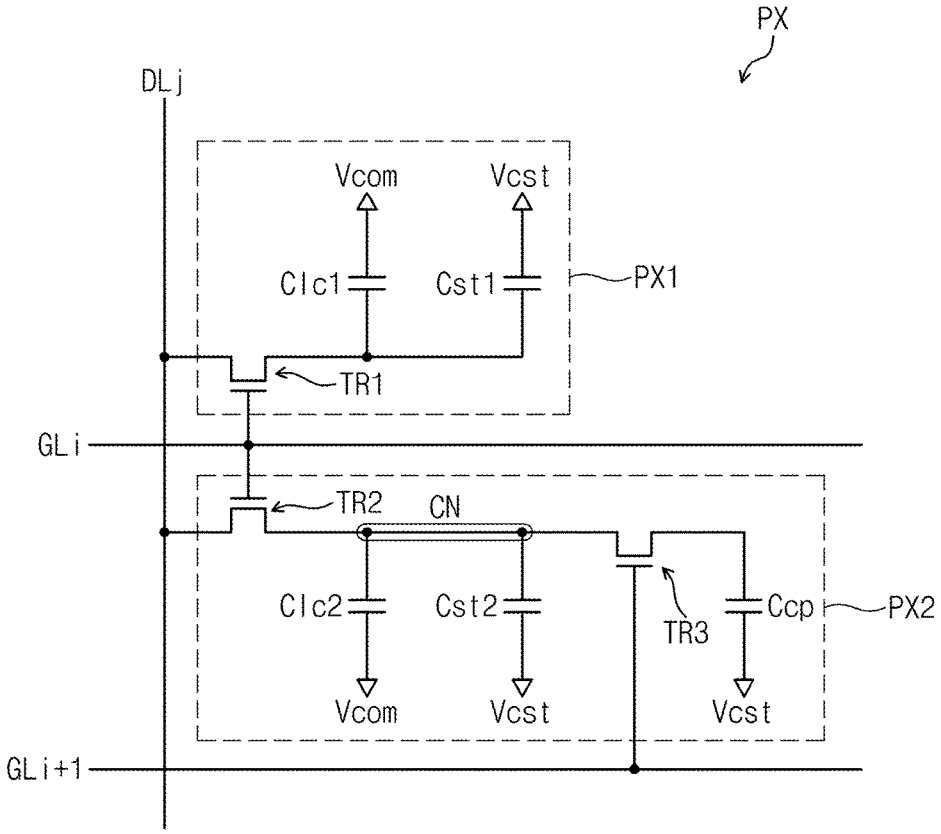
FIG. 12 is another circuit diagram of one pixel, according to an exemplary embodiment of the present disclosure.

FIG. 12 is another circuit diagram of one pixel, according to an exemplary embodiment of the present disclosure. Referring to FIG. 12, a pixel PX includes a first sub-pixel PX1 and a second sub-pixel PX2. The first sub-pixel PX1 includes a first transistor TR1, a first liquid crystal capacitor Clc1, and a first storage capacitor Cst1. The second sub-pixel PX2 includes a second transistor TR2, a third transistor TR3, a second liquid crystal capacitor Clc2, a second storage capacitor Cst2, and a coupling capacitor Ccp.

The first transistor TR1 includes a gate electrode connected to an i-th gate line GLi, a source electrode connected to a j-th data line DLj, and a drain electrode connected to the first liquid crystal capacitor Clc1 and the first storage capacitor Cst1.

The first liquid crystal capacitor Clc1 includes a first electrode connected to the drain electrode of the first transistor TR1 and a second electrode applied with a common voltage Vcom. The first storage capacitor Cst1 includes a first electrode connected to the drain electrode of the first transistor TR1 and a second electrode applied with a storage voltage Vcst.

The second transistor TR2 includes a gate electrode connected to the i-th gate line GLi, a source electrode connected to the j-th data line DLj, and a drain electrode connected to the second liquid crystal capacitor Clc2 and the second storage capacitor Cst2.

The second liquid crystal capacitor Clc2 includes a first electrode connected to the drain electrode of the second transistor TR2 and a second electrode applied with the common voltage Vcom. The second storage capacitor Cst2 includes a first electrode connected to the drain electrode of the second transistor TR2 and a second electrode applied with the storage voltage Vcst.

The third transistor TR3 includes a gate electrode connected to an (i+1)th gate line GLi+1, a source electrode connected to the coupling capacitor Ccp, and a drain electrode connected to the drain electrode of the second transistor TR2. The coupling capacitor Ccp includes a first electrode connected to the source electrode of the third transistor TR3 and a second electrode applied with the storage voltage Vcst.

Although not shown in FIG. 10, when the pixel PX shown in FIG. 12 is used in the display panel 310 shown in FIG. 10, the third transistor TR3 of the second sub-pixel PX2 may be connected to the (i+1)th gate line GLi+1.

The first and second transistors TR1 and TR2 are turned on in response to the gate signal applied thereto through the i-th gate line GLi. The data voltage provided through the j-th data line DLj is applied to the first and second sub-pixels PX1 and PX2 through the turned-on first and second transistors TR1 and TR2. Accordingly, the first pixel voltage corresponding to the difference in level between the data voltage and the common voltage Vcom is charged in the first and second liquid crystal capacitors Clc1 and Clc2.

Then, the third transistor TR3 is turned on in response to the gate signal applied thereto through the (i+1)th gate line GLi+1. When the third transistor TR3 is turned on, a voltage division occurs between the second liquid crystal capacitor Clc2 and the coupling capacitor Ccp.

The voltage at a contact node CN where the drain electrode of the second transistor TR2 is connected to the drain electrode of the third transistor TR3 corresponds to a voltage obtained through a charge-sharing between the second liquid crystal capacitor Clc2, the second storage capacitor Cst2, and the coupling capacitor Ccp. That is, the voltage charged in the second liquid crystal capacitor Clc2 is lowered after a period of time when the gate signal is applied through the (i+1)th gate line GLi+1.

As a result, the first pixel voltage charged in the first liquid crystal capacitor Clc 1 is greater than the second pixel voltage charged in the second liquid crystal capacitor Clc2, and thus the visibility of the display apparatus is improved.

Although exemplary embodiments of the present system and method are described, the present system and method is not limited to these exemplary embodiments. Various changes and modifications may be made by one of ordinary skill in the art without departing from the spirit and scope of the present system and method.

What is claimed is:

1. A display apparatus comprising:

a plurality of gate lines extending in a first direction;

a plurality of data lines extending in a second direction crossing the first direction; and a plurality of pixels connected to the gate lines and the data lines, wherein the pixels comprise pixels arranged in a k-th row and pixels arranged in a (k+1)th row, the pixels arranged in the k-th row are disposed adjacent to the pixels arranged in the (k+1)th row in the second direction such that an (i+1)th gate line of the gate lines is disposed between the pixels arranged in the k-th row and the pixels arranged in the (k+1)th row, each of i and k is a natural number, a first pixel arranged in a g-th column among the pixels arranged in the k-th row and a second pixel arranged in the g-th column among the pixels arranged in the (k+1)th row are connected to a j-th data line, each of g and j is a natural number, and the pixels arranged in the k-th row are alternately connected to an i-th gate line and the (i+1)th gate line, wherein the pixels arranged in the k-th row are alternately connected to the i-th gate line and the (i+1)th gate line every 41 (1 is a natural number) pixels such that a pixel in the k-th row and the g-th column is connected to the i-th gate line and a pixel in the k-th row and a (g+41)th column is connected to the (i+1)th gate line.

2. The display apparatus of claim 1, wherein each of the pixels displays one of red, green, blue, white, yellow, cyan, and magenta colors.

3. The display apparatus of claim 1, wherein the pixels are grouped into a plurality of first pixel groups and a plurality of second pixel groups, and the first pixel groups are alternately arranged with the second pixel groups in the first and second directions.

4. The display apparatus of claim 3, wherein the first pixel groups are applied with data voltages having different polarities from the second pixel groups in each of the k-th row and the (k+1)th row.

5. The display apparatus of claim 3, wherein each of the first and second pixel groups comprises 2h pixels and the h is a natural number.

6. The display apparatus of claim 5, wherein each of the first pixel groups comprises two pixels among red, green, blue, and white pixels, and each of the second pixel groups comprises the other two pixels among the red, green, blue, and white pixels.

7. The display apparatus of claim 6, wherein each of the first pixel groups comprises the red pixel displaying a red color and the green pixel displaying a green color.

8. The display apparatus of claim 6, wherein each of the second pixel groups comprises the blue pixel displaying a blue color and the white pixel displaying a white color.

9. The display apparatus of claim 1, wherein the pixels arranged in the (k+1)th row has the same connection structure as the pixels arranged in the k-th row.

10. The display apparatus of claim 9, wherein adjacent pixels in each group of 41 pixels are alternately connected to the i-th gate line and (i+1)th gate line after every one pixel.

11. The display apparatus of claim 10, wherein, for each group of 41 adjacent pixel columns, a connection structure of the gate lines and the data lines of a first set of pixels applied with data voltages having a positive polarity is the same as that of a second set of pixels PX applied with data voltages having a negative polarity, and the first set of pixels displays the same color as the second set of pixels.

12. The display apparatus of claim 10, wherein the data lines receive data voltages having different polarities from each other every two data lines.

13. The display apparatus of claim 12, wherein the polarity of the data voltages is inverted every frame period.

14. The display apparatus of claim 1, wherein each of the pixels comprises:

a first sub-pixel receiving a corresponding data voltage and being charged with a first pixel voltage; and a second sub-pixel receiving the corresponding data voltage and being charged with a second pixel voltage.

15. The display apparatus of claim 14, wherein the first sub-pixel of a pixel in the k-th row comprises:

a first transistor connected to the i-th gate line and the j-th data line; and a first liquid crystal capacitor connected to the first transistor, and the second sub-pixel comprises:

a second transistor connected to the i-th gate line and the j-th data line;

a second liquid crystal capacitor connected to the second transistor; and a third transistor connected to the i-th gate line and the second liquid crystal capacitor and applied with a storage voltage.

16. The display apparatus of claim 14, wherein the first sub-pixel of a pixel in the k-th row comprises:

a first transistor connected to the i-th gate line and the j-th data line; and a first liquid crystal capacitor connected to the first transistor, and the second sub-pixel comprises:

a second transistor connected to the i-th gate line and the j-th data line;

a second liquid crystal capacitor connected to the second transistor;

a third transistor connected to the second liquid crystal capacitor and the (i+1)th gate line; and a coupling capacitor applied with a storage voltage and connected to the third transistor.

17. The display apparatus of claim 1, wherein each group of 41 (1 is a natural number) adjacent pixels arranged in the k-th row is connected to the i-th gate line and the (i+1)th gate line in the same configuration, and the pixels arranged in the (k+1)th row have the same connection structure as the pixels arranged in the k-th row.

18. The display apparatus of claim 17, wherein, among each group of 41 adjacent pixels, the pixels arranged in the g-th column and the (g+3)th column are connected to the (i+1)th gate line, and the pixels arranged in the (g+1)th column and the (g+2)th column are connected to the i-th gate line.

19. The display apparatus of claim 18, wherein the data lines receive data voltages, and the polarity of the data voltages are inverted every two data lines and every frame period.

20. The display apparatus of claim 18, wherein the number of pixels applied with the data voltages having a positive polarity is equal to the number of pixels applied with the data voltages having a negative polarity for each row of pixels connected to the same gate line.

21. A display apparatus comprising:

a plurality of gate lines extending in a first direction;

a plurality of data lines extending in a second direction crossing the first direction; and a plurality of pixels connected to the gate lines and the data lines, wherein the pixels are grouped into a plurality of first pixel groups and a plurality of second pixel groups, adjacent pixels arranged in a g-th column (g is a natural number) are connected to a j-th data line (j is a natural number), and each of the first pixel groups and each of the second pixel groups, which are arranged in a k-th row (k is a natural number) between an i-th gate line (i is a natural number) and an (i+1)th gate line, are alternately connected to the i-th gate line and the (i+1)th gate line after every one pixel, wherein the pixels arranged in the k-th row are alternately connected to the i-th gate line and the (i+1)th gate line every 41 (1 is a natural number) pixels such that a pixel in the k-th row and the g-th column is connected to the i-th gate line and a pixel in the k-th row and a (g+41)th column is connected to the (i+1)th gate line.

22. The display apparatus of claim 21, wherein adjacent pixels within each group of 41 pixels are alternately connected to the i-th gate line and (i+1)th gate line after every one pixel.

23. The display apparatus of claim 22, wherein, for each group of 41 adjacent pixel columns, a connection structure of the gate lines and the data lines of a first set of pixels applied with data voltages having a positive polarity is the same as that of a second set of pixels PX applied with data voltages having a negative polarity, and the first set of pixels displays the same color as the second set of pixels.

24. The display apparatus of claim 21, wherein the data lines receive data voltages, and the polarity of the data voltages are inverted every two data lines and every frame period.

25. The display apparatus of claim 21, wherein the first pixel groups are alternately arranged with the second pixel groups in the first and second directions, each of the first pixel groups comprises two pixels among red, green, blue, and white pixels, and each of the second pixel groups comprises the other two pixels among the red, green, blue, and white pixels.

26. A method of driving a display apparatus, comprising:

applying gate signals to a plurality of pixels grouped into a plurality of first pixel groups and a plurality of second pixel groups through gate lines extending in a first direction; and applying data voltages to the pixels through data lines extending in a second direction crossing the first direction, wherein the applying of the data voltages comprises applying data voltages having different polarities to the first and second pixel groups arranged in the first direction, the pixels comprise pixels arranged in a k-th row and pixels arranged in a (k+1)th row, the pixels arranged in the k-th row are disposed adjacent to the pixels arranged in the (k+1)th row in the second direction such that an (i+1)th gate line of the gate lines is disposed between the pixels arranged in the k-th row and the pixels arranged in the (k+1)th row, each of i and k is a natural number, a first pixel arranged in a g-th column among the pixels arranged in the k-th row and a second pixel arranged in the g-th column among the pixels arranged in the (k+1)th row are connected to a j-th data line, each of g and j is a natural number, and the pixels arranged in the k-th row are alternately connected to an i-th gate line and the (i+1)th gate line, wherein all pixels having the same color among pixels in the same row are applied with data voltages having the same polarity wherein the pixels arranged in the k-th row are alternately connected to the i-th gate line and the (i+1)th gate line every 41 (1 is a natural number) pixels such that a pixel in the k-th row and the g-th column is connected to the i-th gate line and a pixel in the k-th row and a (g+41)th column is connected to the (i+1)th gate line.

27. The method of claim 26, wherein adjacent pixels within each group of 41 pixels are alternately connected to the i-th gate line and (i+1)th gate line after every one pixel and the pixels arranged in the (k+1)th row have the same connection structure as the pixels arranged in the k-th row.

28. The method of claim 26, wherein each group of 41 (1 is a natural number) adjacent pixels arranged in the k-th row is connected to the i-th gate line and the (i+1)th gate line in the same configuration, the pixels arranged in the g-th column and the (g+3)th column among each group of 41 pixels are connected to the (i+1)th gate line, the pixels arranged in the (g+1)th column and the (g+2)th column among each group of 41 pixels are connected to the i-th gate line, and the pixels arranged in the (k+1)th row have the same connection structure as the pixels arranged in the k-th row.

29. The method of claim 26, wherein the first pixel groups are alternately arranged with the second pixel groups in the first and second directions, each of the first pixel groups comprises two pixels among red, green, blue, and white pixels, and each of the second pixel groups comprises the other two pixels among the red, green, blue, and white pixels.

30. The method of claim 29, wherein the data lines receive data voltages, and the polarity of the data voltages are inverted every two data lines and every frame period.

* * * * *